US007549178B2

(12) United States Patent
Lin et al.

(10) Patent No.: US 7,549,178 B2
(45) Date of Patent: Jun. 23, 2009

(54) PATCH FOR SECURING A SURGICAL GOWN TIE

(75) Inventors: Brian Eric Lin, Atlanta, GA (US); Gregory Scott Hafer, Roswell, GA (US); Jerald Theodore Jascomb, Alpharetta, GA (US); Jennifer Ann Sturm, Alpharetta, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 13 days.

(21) Appl. No.: 11/956,579

(22) Filed: Dec. 14, 2007

(65) Prior Publication Data

US 2009/0094729 A1 Apr. 16, 2009

Related U.S. Application Data

(66) Substitute for application No. 60/979,504, filed on Oct. 12, 2007.

(51) Int. Cl.
*A41D 13/12* (2006.01)

(52) U.S. Cl. ..... 2/51; 2/52; 2/114

(58) Field of Classification Search ..... 2/51, 2/114, 52, 48, 49.1–49.5, 50, 456, 457, 46, 2/76, 79, 82, 83, 85, 87, 88, 336–338, 341, 2/342, 243.1, 244, 266, 901; 24/198, 200, 24/3.1, 31 R, 35, 304, 129 R, 129 B; 604/389, 604/390, 392

See application file for complete search history.

(56) References Cited

U.S. PATENT DOCUMENTS 3,338,992 A 8/1967 Kinney
3,341,394 A 9/1967 Kinney
3,502,763 A 3/1970 Hartmann
3,542,615 A 11/1970 Dobo et al.
3,692,618 A 9/1972 Dorschner et al.
3,721,999 A * 3/1973 Goya et al. ..... 2/114
3,802,817 A 4/1974 Matsuki et al.
3,849,241 A 11/1974 Butin et al.
3,855,046 A 12/1974 Hansen et al.
3,864,757 A * 2/1975 Hartigan ..... 2/114
3,935,596 A * 2/1976 Allen et al. ..... 2/114
3,977,025 A * 8/1976 Horan ..... 2/114
4,019,207 A * 4/1977 Newman et al. ..... 2/51
4,041,203 A 8/1977 Brock et al.
4,106,120 A * 8/1978 Zurbrigg et al. ..... 2/51
4,214,320 A 7/1980 Belkin
4,290,148 A * 9/1981 Roberts ..... 2/51
4,340,563 A 7/1982 Appel et al.

(Continued)

OTHER PUBLICATIONS

Shaw, D.J. *Introduction to Colloid and Surface Chemistry*, Third Edition, Butterworths, 1980, pp. 131-135.

(Continued)

*Primary Examiner*—Amy B Vanatta
(74) *Attorney, Agent, or Firm*—Sue C. Watson

(57) ABSTRACT

A patch having a notch therein and a tie coupled thereto is used to provide a closure for a garment, such as a gown. The notch is formed along an edge of the patch, and the tie is coupled to the patch such that it is positioned to extend across and beyond the notch. The notch acts to disperse tension on the patch when tension is applied to the tie. A gown having a notched patch is also disclosed.

21 Claims, 4 Drawing Sheets

U.S. PATENT DOCUMENTS

| | | | | | |
|---|---|---|---|---|---|
| 4,370,782 | A | * | 2/1983 | Aronica | 24/198 |
| 4,371,986 | A | * | 2/1983 | Wichman | 2/51 |
| 4,374,888 | A | | 2/1983 | Bornslaeger | |
| 4,384,370 | A | * | 5/1983 | Singer | 2/114 |
| 4,451,931 | A | * | 6/1984 | Wichman | 2/51 |
| 4,457,024 | A | * | 7/1984 | Wichman | 2/51 |
| 4,535,481 | A | * | 8/1985 | Ruth-Larson et al. | 2/114 |
| 4,558,468 | A | * | 12/1985 | Landry et al. | 2/51 |
| 5,025,501 | A | | 6/1991 | Dillon | |
| 5,097,534 | A | * | 3/1992 | Viemeister et al. | 2/69 |
| 5,145,727 | A | | 9/1992 | Potts et al. | |
| 5,169,706 | A | | 12/1992 | Collier, IV et al. | |
| 5,178,931 | A | | 1/1993 | Perkins et al. | |
| 5,188,885 | A | | 2/1993 | Timmons et al. | |
| 5,594,955 | A | | 1/1997 | Sommers | |
| 5,695,868 | A | | 12/1997 | McCormack | |
| 6,037,281 | A | | 3/2000 | Mathis et al. | |
| 6,049,907 | A | * | 4/2000 | Palomo | 2/51 |
| 6,378,136 | B2 | | 4/2002 | Matsushita | |
| 2008/0155728 | A1 | * | 7/2008 | Hafer et al. | 2/69 |

OTHER PUBLICATIONS

Zettlemoyer, A.C., *Hydrophobic Surfaces*, Edited by F.M. Fowkes, Academic Press, New York, 1969, p. 1.

* cited by examiner

PATCH FOR SECURING A SURGICAL GOWN TIE

CROSS-REFERENCE TO RELATED APPLICATIONS

This application claims priority to provisional U.S. Application No. 60/979,504, filed Oct. 12, 2007, entitled "Patch For Securing A Surgical Gown Tie," by Brian Eric Lin, et al.

BACKGROUND

This invention relates to securing protective attire commonly used in medical or industrial environments, and so forth, using a tie. More particularly, this invention relates to a patch for holding at least a portion of a tie on such attire or garments, such as a surgical gown, so that the tie desirably does not disconnect from the patch, and the patch does not disconnect from the gown and/or tear the gown.

As is generally known, garments, such as, for example only, sterile surgical gowns, are designed to greatly reduce, if not prevent, the transmission through the gown of liquids and biological contaminates which may become entrained therein. In surgical procedure environments, such liquid sources include the gown wearer's perspiration, patient liquids such as blood, salvia, perspiration, sputum, life support liquids such as plasma and saline, and so forth.

Many surgical gowns were originally made of cotton or linen and were sterilized prior to their use in the operating room. These gowns, however, permitted transmission or "strikethrough" of many of the liquids encountered in surgical procedures. These gowns were undesirable, if not unsatisfactory, because such "strikethrough" established a direct path for transmission of bacteria and other contaminates which wick to and from the wearer of the gown. Furthermore, the gowns were costly, and, of course, laundering and sterilization procedures were required before reuse.

One use, disposable surgical gowns have largely replaced linen and/or cotton surgical gowns. Gowns which partially wrap around a wearer, using gown ties positioned on the gown are particularly popular, due to comfort and adjustability of the gown. Such gowns usually open in the back, and have a set of ties. Some ties may hold the back of the gown together loosely, while other ties coupled to at least one back panel wrap around to at least a portion of a front of the gown which has a corresponding tie attached thereto. Securing the tie on the front of the gown has become problematic.

Due to the barrier material that is desirably provide on at least a portion of the front of the gown, it is undesirable to have a stitched seam to hold the front tie. Stitching creates openings into the barrier material. Further, a stitched seam, when the tie is tugged, may tear the gown, eliminating the desirable barrier provide on the front of the gown. Further, standard methods of heat sealing a front tie to the gown tends to damage the barrier properties on the front of the gown, weakening or causing a breach in the barrier material. Similarly, ultrasound techniques to couple a tie to the front of the gown have also damaged or effected the barrier material. Other mechanical coupling of the tie to the front of the gown, such as stapling, and so forth, also damage the gown and effect the barrier properties.

Adhesives have therefore been used to hold the front tie to the gown. Adhesives frequently fail, and the front tie therefore is pulled free from the front of the gown, causing the gown to open. There is a need to secure a tie to a front of a garment, such as a nonwoven gown, wherein the gown's barrier material is not easily breached, torn, weakened, or otherwise affected negatively. Further, there is a need to secure a tie to a front of a nonwoven gown so that the tie is firmly coupled to the nonwoven gown, to securely hold the gown in a closed position about a wearer. Such an apparatus to hold a tie needs to hold the tie securely, even if there is some strong tension on the tie. Such an apparatus would desirably be reasonably inexpensive, easy to use, and operate well with the gown's fabric and barrier material.

SUMMARY OF THE INVENTION

In response to the difficulties and problems discussed herein, a nonwoven garment having a patch thereon in which a tie is coupled thereto is provided. The garment includes a front panel, a first back panel and a second back panel. A back tie is coupled to a portion of at least one of the first back panel or the second back panel. The nonwoven garment also includes a patch thereon. The patch includes a notch formed therein. The patch has a pair of spaced-apart arms. The patch also includes a front tie coupled to at least a portion of the patch. The front tie is positioned to cross the notch and extend outward away from the notch and the patch. The patch is positioned on the front panel. When the tie is pulled in about a ninety degree angle relative to the patch, the arms adjacent the notch move downward against a fabric of the garment thereby holding the patch firmly thereon. The back tie and the front tie are configured to couple together to hold the garment at least about a wearer.

In another aspect of the invention, a notched patch in which a tie is coupled thereto for use on a nonwoven garment is provided. The patch includes a notch formed therein. The patch has a pair of spaced-apart arms. The patch also has a tie coupled to at least a portion of the patch such that the tie is positioned to cross the notch and extend outward away from the notch. The patch is coupled to a garment. When the tie is pulled at about a ninety degree angle relative to the notched patch, the arms adjacent the notch move downward against a fabric of a garment thereby holding the patch firmly thereon.

DEFINITIONS

Figure 1:
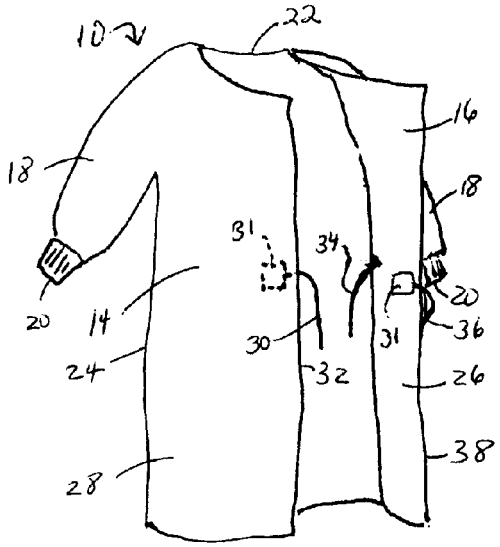
FIG. 1 is a perspective view of an apparel or a gown of the present invention, showing a left or first back portion and a right or second back portion, the second back portion opened up to show attachment ties.

As used herein the following terms have the specified meanings, unless the context demands a different meaning, or a different meaning is expressed; also, the singular generally includes the plural, and the plural generally includes the singular unless otherwise indicated.

As used herein, the terms "comprise", "comprises", "comprising" and other derivatives from the root term "comprise" are intended to be open-ended terms that specify the presence of any stated features, elements, integers, steps, or components, but do not preclude the presence or addition of one or more other features, elements, integers, steps, components, or groups thereof. Similarly, the terms "include", "includes", "has" and/or "have", and derivatives thereof, are intended to be interpreted as the word "comprise", and are intended to be open-ended terms that specify the presence of any stated features, elements, integers, steps, or components, but do not preclude the presence or addition of one or more other features, elements, integers, steps, components, or groups thereof.

As used herein, the terms "fabric" or "material" refers to all woven, knitted and nonwoven fibrous webs, unless one type is specified. The terms "fabric" or "material" is used broadly herein to mean any planer textile structure produced by interlacing yarns, fibers or filaments. Thus, the fabric can be a woven or nonwoven web, either of which is readily prepared by methods well known to those having ordinary skill in the art. For example, nonwoven webs are prepared by such processes as meltblowing, coforming, spunbonding, carding, air laying, and wet laying. Moreover, the fabric can consist of a single layer or multiple layers. In addition, a multilayered fabric can include films, scrim, and other non-fibrous materials. Desirable materials or fabric(s) are disclosed, for example, in U.S. Pat. No. 6,037,281 issued to Mathis et al., and in U.S. Pat. No. 5,695,868, issued to McCormick, both of which are incorporated by reference herein in their entirety.

As used herein, the term "layer" when used in the singular can have the dual meaning of a single element or a plurality of elements.

As used herein the term "meltblown fibers" means fibers formed by extruding a molten thermoplastic material through a plurality of fine, usually circular, die capillaries as molten threads or filaments into converging high velocity, usually hot, gas (e.g. air) streams which attenuate the filaments of molten thermoplastic material to reduce their diameter, which may be to microfiber diameter. Thereafter, the meltblown fibers are carried by the high velocity gas stream and are deposited on a collecting surface to form a web of randomly dispersed meltblown fibers. Such a process is disclosed, for example, in U.S. Pat. No. 3,849,241 to Butin et al. which is incorporated by reference herein in its entirety. Meltblown fibers are microfibers which may be continuous or discontinuous, are generally smaller than 10 microns in average diameter, and are generally tacky when deposited onto a collecting surface.

As used herein "multi-layer laminate" means a laminate wherein some of the layers are spunbond and some meltblown such as a spunbond/meltblown/spunbond (SMS) laminate and others as disclosed in U.S. Pat. No. 4,041,203 to Brock et al., U.S. Pat. No. 5,169,706 to Collier, et al., U.S. Pat. No. 5,145,727 to Potts et al., U.S. Pat. No. 5,178,931 to Perkins et al. and U.S. Pat. No. 5,188,885 to Timmons et al. each of which are incorporated by reference herein in their entirety. Such a laminate may be made by sequentially depositing onto a moving forming belt first a spunbond fabric layer, then a meltblown fabric layer and last another spunbond layer and then bonding the laminate in a manner described below. Alternatively, the fabric layers may be made individually, collected in rolls, and combined in a separate bonding step. Such fabrics usually have a basis weight of from about 0.1 to 12 osy (6 to 400 gsm), or more particularly from about 0.75 to about 3 osy. Multi-layer laminates may also have various numbers of meltblown (M) layers or multiple spunbond (S) layers in many different configurations and may include other materials like films (F) or coform materials, e.g. SMMS, SM, SFS, SMS etc.

As used herein the terms "bonded" and "bonding" refer to the joining, adhering, connecting, attaching, or the like of two elements. Two elements will be considered to be bonded together when they are bonded directly to one another or indirectly to one another, such as when each is directly bonded to intermediate elements. Such bonding may occur for example, by adhesive, thermal or ultrasonic methods.

As used herein the term "thermal point bonding" or "thermal bonding" involves passing a fabric or web of fibers to be bonded between a heated calendar roll and an anvil roll. When layers of fabric, or two or more fabrics, are thermally bonded, the fabric(s) is/are respectively, heated to a melting point, such that all pores, capillaries, and so forth, if any, in the material collapse and/or are sealed in the melting process. The integrity and continuity of the material is maintained (i.e., the material does not become too thin or perforated in the bonded areas).

The calender roll is usually, though not always, patterned in some way so that the entire fabric is not bonded across its entire surface (thermal point bonding), and the anvil roll is usually flat. As a result, various patterns for calendar rolls have been developed for functional as well as aesthetic reasons. One example of a pattern has points and is the Hansen Pennings or "H&P" pattern with about a 30% bond area with about 200 bonds/square inch as taught in U.S. Pat. No. 3,855,046 to Hansen and Pennings, incorporated herein by reference in its entirety. The H&P pattern has square point or pin bonding areas wherein each pin has a side dimension of 0.038 inches (0.965 mm), a spacing of 0.070 inches (1.778 mm) between pins, and a depth of bonding of 0.023 inches (0.584 mm). The resulting pattern has a bonded area of about 29.5%. Another typical point bonding pattern is the expanded Hansen Pennings or "EHP" bond pattern which produces a 15% bond area with a square pin having a side dimension of 0.037 inches (0.94 mm), a pin spacing of 0.097 inches (2.464 mm) and a depth of 0.039 inches (0.991 mm). Another typical point bonding pattern designated "714" has square pin bonding areas wherein each pin has a side dimension of 0.023 inches, a spacing of 0.062 inches (1.575 mm) between pins, and a depth of bonding of 0.033 inches (0.838 mm). The resulting pattern has a bonded area of about 15%. Yet another common pattern is the C-Star pattern which has a bond area of about 16.9%. The C-Star pattern has a cross-directional bar or "corduroy" design interrupted by shooting stars. Other common patterns include a diamond pattern with repeating and slightly offset diamonds with about a 16% bond area and a wire weave pattern looking as the name suggests, e.g. like a window screen, with about a 19% bond area. Typically, the percent bonding area varies from around 10% to around 30% of the area of the fabric laminate web. As is well known in the art, the spot bonding holds the laminate layers together as well as imparts integrity to each individual layer by bonding filaments and/or fibers within each layer.

As used herein, the term "ultrasonic bonding" or "ultrasonic welding" means a process performed, for example, by passing a fabric, such as a nonwoven material, between a sonic horn and anvil roll as illustrated in U.S. Pat. No. 4,374,888 to Bornslaeger, incorporated by reference herein in its entirety. When layers of fabric, or two or more fabrics, are ultrasonically bonded, the fabric(s) is/are respectively, heated to a melting point, such that all pores, capillaries, and so forth, if any, in the material collapse and/or are sealed in the melting process. The integrity and continuity of the material is maintained (i.e., the material does not become too thin or perforated in the bonded areas).

As used herein, the terms "nonwoven" and "nonwoven fabric" mean either a nonwoven web, a film, a foam sheet material, or a combination thereof.

As used herein the terms "fibrous nonwoven" and "fibrous nonwoven fabric or web" mean a web having a structure of individual fibers, filaments or threads which are interlaid, but not in an identifiable manner as in a knitted fabric. Fibrous nonwoven fabrics or webs have been formed from many processes such as for example, meltblowing processes, spunbonding processes, and bonded carded web processes. The basis weight of fibrous nonwoven fabrics is usually expressed in ounces of material per square yard (osy) or grams per square meter (gsm) and the fiber diameters useful are usually expressed in microns. (Note that to convert from osy to gsm, multiply osy by 33.91).

As used herein, the terms "surgical gown", "garment", "apparel", and "attire" shall encompass medical garments or medical workwear and other forms of protective attire used by various industries/professions/trades to protect workers from contaminants or to prevent the contamination of others. Such protective attire includes but is not limited to hospital and surgical gowns, medical scrubs, medical drapes, coveralls, and garments used to protect either a portion of a wearer's body, such as, for example only, a shirt or pants, alternatively, a substantial portion of a wearer's entire body. Such as, for example only, coveralls. For the purposes of this application, the terms "garment(s)", "gown(s)", "attire", "apparel" and/or "work wear" are used synonymously.

As used herein the term "spunbonded fibers" refers to small diameter fibers which are formed by extruding molten thermoplastic material as filaments from a plurality of fine, usually circular capillaries of a spinneret with the diameter of the extruded filaments then being rapidly reduced as by, for example, in U.S. Pat. No. 4,340,563 to Appel et al., U.S. Pat. No. 3,692,618 to Dorschner et al., U.S. Pat. No. 3,802,817 to Matsuki et al., U.S. Pat. Nos. 3,338,992 and 3,341,394 to Kinney, U.S. Pat. No. 3,502,763 to Hartman, and U.S. Pat. No. 3,542,615 to Dobo et al. each of which are incorporated by reference herein in their entirety. Spunbond fibers are generally not tacky when they are deposited onto a collecting surface. Spunbond fibers are generally continuous and often have average diameters (from a sample of at least 10) larger than 7 microns, more particularly, between about 10 and 20 microns.

As used herein, the term "hydrophobic" shall generally refer a nonwoven fabric that does not promote the spreading of water. The water instead, forms drops and a contact angle that can be measured from the plane of the fiber/material surface, tangent to the water surface at the three-phase boundary line (air-water-fiber). Typically the contact angle ranges from 40-110 degrees, and is often greater than 90 degrees. The fiber/material also demonstrates a surface tension or energy of less than about 50 dynes/cm, such as between about 10-50 dynes/cm. Further elaboration on hydrophobic materials may be found in Hydrophobic Surfaces, edited by F. M. Fowkes of the Academic Press, New York, 1969, page 1. Hydrophobic fabrics may be produced from materials that are inherently hydrophobic or from hydrophilic fibers/films that have been treated in some fashion to be hydrophobic. Such treatment may include chemical treatments.

Contact angles can be measured by standard measurement techniques such as those described in the Introduction to Colloid and Surface Chemistry by Duncan J. Shaw, Third Edition, Butterworths 1980, pages 131-135, incorporated herein by reference. Surface energy of materials can be measured using dyne pen sets, such as those available from UV Process Supply, Inc., of Chicago, Ill. However, additional methods of measuring surface energy include Torsion Balance apparatus and other devices, which utilize platinum rings, such as those available from Torsion Balance Supplies of the United Kingdom.

As used herein, the term "film" may refer to a breathable film or a nonbreathable film. A film layer used as a portion of the fabric described herein can be formed of any film that can be suitably bonded or attached to top and/or bottom layers of the fabric or nonwoven to yield a barrier material having the unique combination of performance characteristics and features described herein. Such a film layer is desirably formed from a polymer.

For a breathable, microporous film, a suitable class of film materials may includes at least two basic components: a thermoplastic elastomeric polyolefin polymer and a filler. These (and other) components can be mixed together, heated and then extruded into a mono-layer or multi-layer film using any one of a variety of film-producing processes known to those of ordinary skill in the film processing art. Such film-making processes include, for example, cast embossed, chill and flat cast, and blown film processes.

Generally, on a dry weight basis, based on the total weight of the film, a breathable film layer may include from about 30 to about 60 weight percent of the thermoplastic polyolefin polymer, or blend thereof, and from about 40 to about 70 percent filler. Other additives and ingredients may be added to the film layer 14 provided they do not significantly interfere with the ability of the film layer to function in accordance with the teachings of the present invention. Such additives and ingredients can include, for example, antioxidants, stabilizers, and pigments.

In addition to the polyolefin polymer, a breathable film layer also desirably includes a filler. As used herein, a "filler" is meant to include particulates and other forms of materials which can be added to the film polymer extrusion blend and which will not chemically interfere with the extruded film but which are able to be uniformly dispersed throughout the film. Generally, the fillers will be in particulate form and may have a spherical or non-spherical shape with average particle sizes in the range of about 0.1 to about 7 microns. Both organic and inorganic fillers are contemplated to be within the scope of the present invention provided that they do not interfere with the film formation process, or the ability of the film layer to function in accordance with the teachings of the present invention. Examples of suitable fillers include calcium carbonate (CaCO3), various kinds of clay, silica (SiO2), alumina, barium carbonate, sodium carbonate, magnesium carbonate, talc, barium sulfate, magnesium sulfate, aluminum sulfate, titanium dioxide (TiO2), zeolites, cellulose-type powders, kaolin, mica, carbon, calcium oxide, magnesium oxide, aluminum hydroxide, pulp powder, wood powder, cellulose derivatives, chitin and chitin derivatives. A suitable coating, such as, for example, stearic acid, may also be applied to the filler particles.

A breathable film layer may be formed using any one of the conventional processes known to those familiar with film formation. The polyolefin polymer and filler are desirably mixed in appropriate proportions and then heated and extruded into a film. In order to provide uniform breathability as reflected by the water vapor transmission rate of the film, the filler should be uniformly dispersed through-out the polymer blend and, consequently, throughout the film layer itself so that upon stretching pores are created to provide breathability. For purposes of the present invention, a film is considered "breathable" if it has a water vapor transmission rate of at least 300 grams per square meter per 24 hours (g/m2/24 hours), as calculated using the test method described herein. Generally, once the film is formed, it will have a weight per unit area of less than about 80 grams per square meter (gsm) and after stretching and thinning, its weight per unit area will be from about 10 gsm to about 25 gsm. It will be understood that any breathable or non-breathable film known in the art may be used in the present invention.

As used herein, the term "wick" or "wicking" shall mean to carry moisture/liquid away, typically by capillary action. Such term also encompasses the ability of a liquid to travel between sheet materials, such as between the surface of a fibrous nonwoven sheet material such as a surgical drape and a film sheet, such as a glove.

As used herein, the term "contaminant" shall mean a chemical agent or biological organism/pathogen that can potentially harm a human being or animal.

As used herein, the terms used to describe affixing the various layers or portions of the surgical gown together include "join", "secure", "attach" and derivatives and synonyms thereof. Such affixing may be accomplished by any of several conventional methods. By way of example and not limitation, these methods include stitching, gluing, heat sealing, zipping, snapping, ultrasonic or thermal bonding, using a hook and loop fastening system, and other mechanisms and methods familiar to those skilled in the art. Adhesives suitable for securing the various layers of the present invention together include construction adhesives and pressure sensitive hot-melt adhesives such as Findly H2096 or H2088. Findly adhesives are available from Findly Adhesive Inc. of Wauwatosa, Wis.

As used herein, the term "outer" or "outside" describes that surface of the garment or gown which faces away from the wearer when the garment is being worn.

As used herein, the term "inner" or "inside" refers to the surface of the garment or gown, or part thereof which faces either the clothes or body of the wearer.

As used herein, the term "liquid" refers to any liquid, fluid, or mixture of gas and liquid; various types of aerosols and particulate matter may be entrained with such liquids.

As used herein, the term "couple" includes, but is not limited to, joining, connecting, fastening, linking, tying, adhering (via an adhesive), or associating two things integrally or interstitially together.

As used herein, the term "configure" or "configuration", and derivatives thereof means to design, arrange, set up, or shape with a view to specific applications or uses. For example: a military vehicle that was configured for rough terrain; configured the computer by setting the system's parameters.

As used herein, the terms "substantial" or "substantially" refer to something which is done to a great extent or degree; a significant or great amount; for example, as used herein "substantially" as applied to "substantially" covered means that a thing is at least 70% covered.

As used herein, the term "alignment" refers to the spatial property possessed by an arrangement or position of things in a straight line or in parallel lines.

As used herein, the terms "orientation" or "position" used interchangeably herein refer to the spatial property of a place where or way in which something is situated; for example, "the position of the hands on the clock."

As used herein, the term "about" adjacent to a stated number refers to an amount that is plus or minus ten (10) percent of the stated number.

As used herein, the term "barrier material" or "barrier materials" refers to a laminate comprising three layers—a top nonwoven layer formed, for example, of spunbond filaments, a bottom nonwoven layer formed, for example, of spunbond filaments, and a middle breathable film layer formed, for example, of a microporous film. The individual layers of barrier material are laminated, bonded or attached together by known means, including thermal-mechanical bonding, ultrasonic bonding, adhesives, and the like. As used herein, the terms "layer" or "web" when used in the singular can have the dual meaning of a single element or a plurality of elements. In another alternative, the material is a nonwoven material of any type known in the art having a film or polymer layer or coating. Such a film or polymer layer or coating is desirably provided in a range of about 0.5 mils to about 3.0 mils.

These terms may be defined with additional language in the remaining portions of the specification.

DETAILED DESCRIPTION OF THE INVENTION

Reference will now be made in detail to one or more embodiments of the invention, examples of which are illustrated in the drawings. Each example and embodiment is provided by way of explanation of the invention, and is not meant as a limitation of the invention. For example, features illustrated or described as part of one embodiment may be used with another embodiment to yield still a further embodiment. It is intended that the invention include these and other modifications and variations as coming within the scope and spirit of the invention.

Turning now to the drawings as illustrated in FIGS. 1-9, and in particular, to FIGS. 1-4, a protective attire or a surgical gown 10 is schematically illustrated. The surgical gown 10 may be formed from several pieces of material or fabric 11 joined together, or the surgical gown 10 may be formed from a single piece or web of fabric or material. Different surgical gowns and their method of manufacture are disclosed, for example, but not by way of limitation, in U.S. Pat. Nos. 4,214,320, 5,025,501, 6,378,136, and so forth. The surgical gown 10 includes a front panel or front 12 configured to substantial cover a front of a wearer. The front panel or front 12 also substantially covers an upper and lower front torso of a wearer, as well as at least a front of an upper portion of the legs of a wearer. The surgical gown 10 also includes first and second back panels or portions 14, 16. The first and second back panels or portions 14, 16 cooperate to substantially cover the back of a wearer. That is, the first and second back panels or portions 14, 16, when tied into a closed position about a wearer, desirably overlap somewhat and cooperate to substantially cover a back upper and lower torso of a wearer, as well as at least a back of an upper portion of the legs of a wearer. The front 12 and the first and second back portions 14, 16 may comprise a single web of fabric or material, which may be a laminate. Alternatively, the front 12 may comprise one piece of fabric, and the first and second back portions 14, 16, may comprise separate pieces of fabric. In another alternative, the front 12 may comprise multiple pieces of fabric and/or the first and second back portions 14, 16 may comprise multiple pieces of fabric.

A pair of sleeves 18 are desirably coupled to and/or are provided as a part of the surgical gown 10. Each sleeve 18 is often, but not by way of limitation, provided as a separate portion of the gown 10. The sieves 18 may be coupled to the gown 10 by stitching, heat bonding or sealing, adhesively bonding, ultrasounically bonding and/or sealing, and so forth. Sleeves 18 desirably have cuffs 20 at each free end thereof. The sleeves 18 may cooperate with the front 12 and/or the first and second back portions 14, 16 to provide a neckline 22 for the gown 10 (not shown) The front 12 and the first and second back portions 14, 16 provide a neckline, as shown in FIGS. 1-4.

Once the attire or gown 10 is provided, it will be appreciated that the front 12 and the back portion 14, 16, cooperate to provide a pair of lateral sides (left lateral and right later sides) 24 of the gown 10. The lateral sides 24 are positioned adjacent lateral sides, i.e., left and right sides, of a wearer. The gown 10 also has an inner surface 26 and an outer surface 28. The inner surface 26 is positioned against a wearer; the outer surface 28 is positioned away from a wearer, and, desirably, has one or more barriers or barrier properties.

Figure 2:
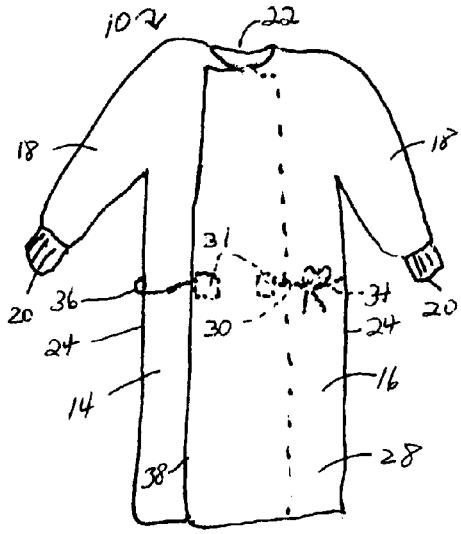
FIG. 2 is a perspective view of the gown of FIG. 1, but showing the second back portion closed over the first back portion (which is shown partially by phantom lines), the ties of the first back portion tied to provide a partial closure and the tie of the second back portion extending around a left lateral side of the gown.
Figure 3:
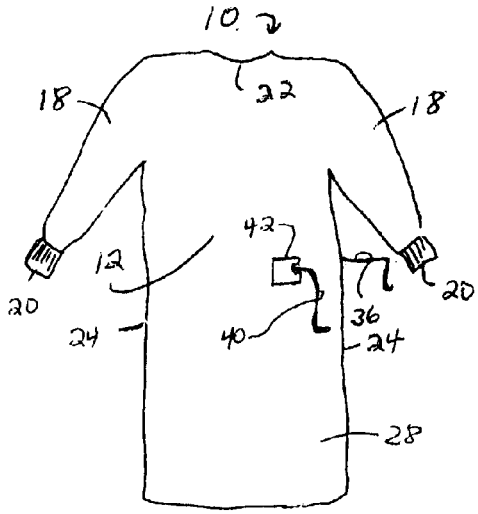
FIG. 3 is a perspective front view of the gown of FIGS. 1 and 2, but showing the front of the gown and showing the tie from the right back panel and a front tie on the front attached to the front by a notched patch.
Figure 4:
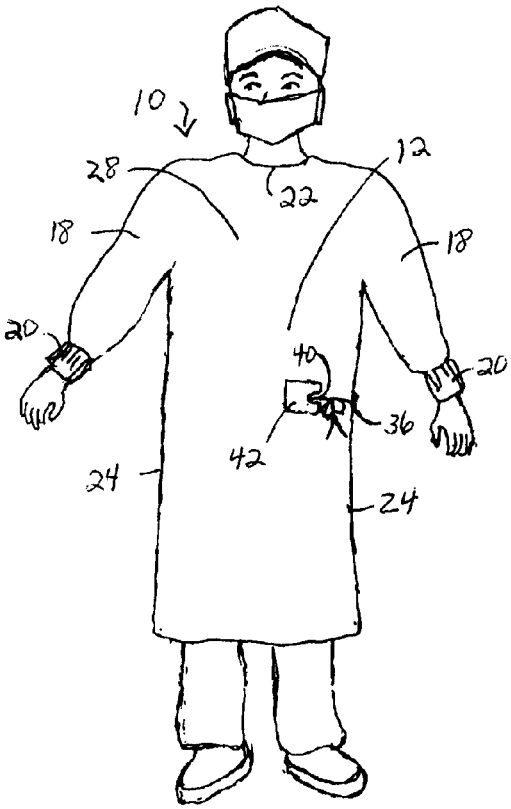
FIG. 4 is a perspective front view similar to FIG. 3, but showing a wearer in the gown and the front tie and back tie tied in a bow, to secure the gown about the wearer.

The first back portion 14 is desirably smaller than the second back portion 16, and may be positioned on a left side 24 of the gown 10. The first back portion 14 desirably has a tie 30 coupled on or adjacent to a free edge 32 of the first back portion 14. The tie 30 may be coupled to the outer surface 28 (not shown), or, desirably, on an inner surface 26 of the first back portion 14 of the gown 10. The tie 30 may be coupled to the fabric 11 of the gown 10 by a patch, such as an adhesive patch 31, as shown in FIGS. 1-3. However, the tie may be coupled to the fabric 11 of the gown 10 by any means or method described herein or known in the art. A corresponding inner tie 34 is desirably coupled to an inner surface 26 of the gown 10, desirably on or adjacent to a lateral side 24 opposite the first back portion 14. When the gown 10 is donned by a wearer, the first back portion 14 is secured by tying the tie 30 to the inner tie 34, so that the first back portion 14 and the front 12 of the gown 10 is secured about a wearer.

The second back portion 16 is wider, and may desirably be positioned on the right lateral side 24 of the gown 10. When the gown 10 is donned and secured about a wearer, the second back portion 16 overlaps a portion of the (left) first back portion 14. The second back portion 16 may, in some instances, overlap a portion of a lateral side 24 of the gown 10 as well (not shown). The back portion 16 includes a back tie 36 coupled on or near a free edge 38 of the gown 10 via a patch 31. The back tie 36 may be coupled to an inner surface 26 of the gown 10, but it will be understood that the back tie 36 may, alternatively, be coupled to an outer surface 28 or a free edge 38 of the gown (not shown). A corresponding front tie 40 is coupled to the fabric 11 on the front 12 of the gown 10 via a notched patch 42. Desirably, but not by way of limitation, the notched patch 42 is positioned off-center on the front 12 and adjacent to or near the left lateral side 24 of the gown 10, near or about the mid-torso area of a wearer. The back tie 36 extends from the second back portion 16, across at least a portion of the first back portion 14, and over a portion of the front 12 to tie to the front tie. The gown 10 is secured about a wearer in this manner.

As illustrated in FIGS. 4-9, the notched patch 42 comprises, in the present embodiment, but not by way of limitation, a generally rectangular notched patch 42 and desirably has an outer peripheral edge 43 having rounded corners. The peripheral edge 43 includes a pair of short edges 44 and a pair of long edges 46. One short side 44 of the notched patch 42 positioned nearest a left lateral side 24 desirably has a generally semi-circular indentation or notch 48 formed in the short edge 42 of the notched patch 42. The notched patch 42 also has an upper surface 50 and a lower surface 52. The lower surface 52 desirably includes an adhesive thereon which substantially covers the lower surface 52. The adhesive desirably includes, but not by way of limitation, a pressure sensitive adhesive. A portion 54 of the front tie 40 is desirably coupled to the lower surface 52 of the notched patch 42 and is held coupled thereto to by adhesive on the lower surface 52. The notched patch 42 is then desirably coupled to the front 12 of the gown 10 via the adhesive thereon.

The front tie 40 is coupled to extend from between the notched patch 42 and the front 12 of the gown 10 and through the notch 48. The front tie 40 is positioned to extend toward the nearest lateral side 24, i.e., adjacent to the left lateral side 24 of the gown 10 near or about in the mid-torso area of a wearer. The front tie 40 desirably couples to the back tie 36 from the second back portion 16 of the gown 10, on or near the left lateral side 24 of the gown 10 on the front 12 of the gown 10.

The notched patch 42 may be formed from any material or combination of materials. Such materials may includes paper, plastic, polymer film, one or more nonwoven fabrics, polyester, nylon, silicone, wax, laminates of any of the foregoing, and so forth. In one embodiment, however, the notched patch is formed from paper, but has an upper surface which is, desirably formed from a barrier material, such as a silicone laminate. It is desirable that the upper surface 50 of the notched patch 42 is constructed from a material which is resistant or impervious to liquid.

The ties 30, 34, 36, 40 described herein may be formed from any material or combinations of materials. Such materials may include nonwoven fabrics, polymer film, polyester, nylon, paper, laminates thereof, and so forth.

The indentation or notch 48 in the notched patch 42 may desirably include a "C", "V," or "U" configuration. However, any regular configuration (such, but not by way If limitation, semi-circular, semi-elliptical, etc.), irregular or asymmetric configuration, or combination of configuration(s) to form the indentation or notch 48 may be utilized in the notched patch 42, so long as the notched patch 42 operates as shown and/or described herein.

It will be appreciated that the configuration of the notched patch 42 shown herein is merely one example; the configuration for the notched patch 42 is intended as non-limiting. Therefore, the notched patch 42 may be any shape, size, configuration, such as, for example, but not by way of limitation, square, round, elliptical, rectangular, and so forth, with a notch 48 therein, so long as it operates as shown and/or described herein.

Figure 6:
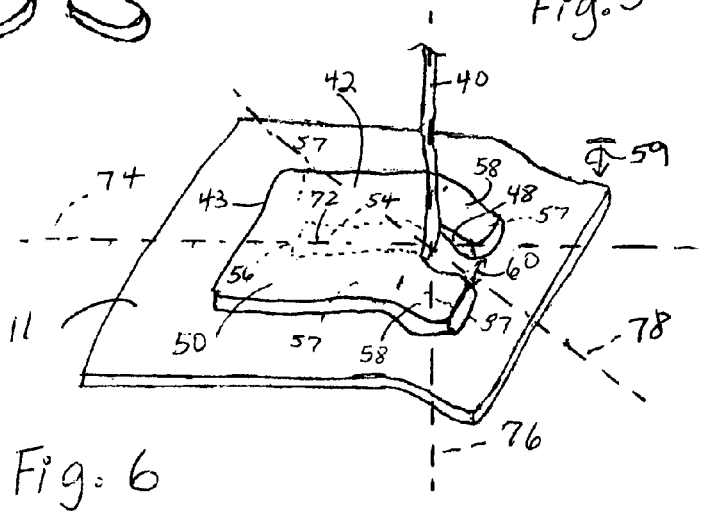
FIG. 6 is a partial perspective view of the notched patch of FIG. 5, but showing the action of the notched patch against the fabric when tension is applied to the tie.

Desirably, the adhesive on the notched patch 42 is sufficient to adhesively connect to the front tie 40. The front tie 40 is coupled only to the notched patch 42, and not to the front 12 of the gown. In addition, the adhesive desirably adhesively couples the notched patch 42 around an outer periphery 56 of the portion 54 of the front tie 40 which is positioned against the notched patch 42. Therefore, a coupled area 57 (FIG. 8) of the notched patch 42 extends beyond the outer periphery 56 of the front tie 40 to hold the front tie 40 adjacent to the gown 10, with out causing a tear or breach in the barrier of the gown 10 or inadvertently releasing the front tie 40 through a failure of the adhesive on the notched patch 42. The remaining lower surface 52 of the notched patch 42 not coupled to the front tie 40 is coupled to the fabric 11 of the front 12 of the gown 10. As described below, this permit a force of a pull against the front tie 40 to be dispersed more widely across the notched patch 42 (FIG. 6).

The notched patch 42 desirably includes two arms 58 which are formed by the notch 48 in the notched patch 42, and which are therefore positioned in a spaced-apart and confronting orientation relative to each other. The natural action of the notched patch 42 when the front tie 40 is pulled in a direction or angle of at least about ninety (90) degrees in relation to the orientation of the notched patch 42 is that the two arms 58 pull or push in a downward direction 59 and somewhat toward each other such that the space 60 between the arms 58 is decreased (FIG. 6) when the front tie 40 is pulled. This action by the notched patch 42 orients and holds the notched patch 42 firmly against the fabric 11 of the front 12 of the gown 10. In contrast, other patches such as patches 31 and prior art patch 62, which are known in the prior art, do not have notches, and have a different action to the pressure and friction when a tie coupled thereto is pulled.

Figure 10:
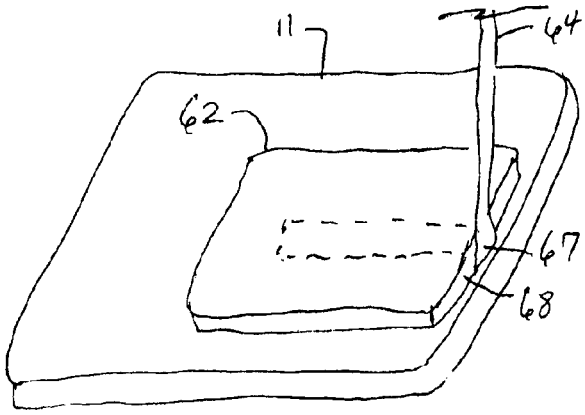
Prior Art Fig. 10
FIG. 10 is a perspective view of a prior art patch and a tie partially attached thereto.
Figure 11:
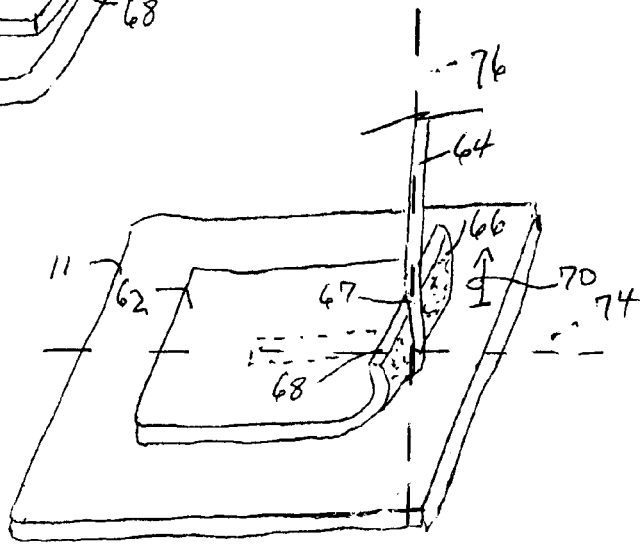
Prior Art Fig. 11
FIG. 11 is a perspective view of the prior art patch of FIG. 10, after tension is applied to the tie.
Figure 12:
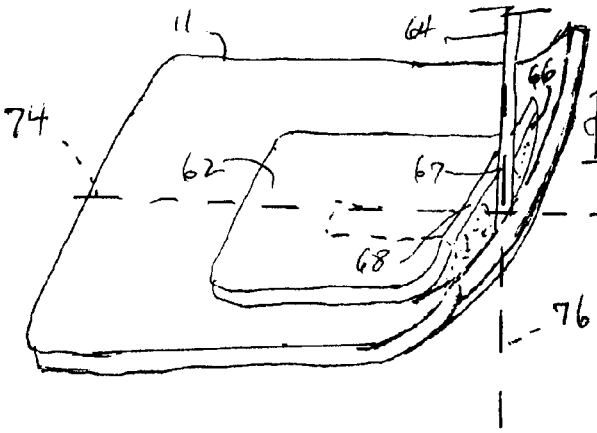
Prior Art Fig. 12
FIG. 12 is a perspective view of the prior art patch of FIGS. 10 and 11, but showing the action of the fabric when increased tension is applied to the tie.

For example, turning to prior art patch 62, illustrated in FIGS. 10-12, a tie 64 is coupled to a lower surface 66 via an adhesive of the patch 62. The patch 62 is coupled to a fabric, such as, for example, fabric 11 shown and previously described herein. When the tie is pulled at about a ninety (90) degree angle relative to the orientation of the patch 62, at least a portion 67 of the tie 64 positioned adjacent an edge 68 of the patch 62, as well as the edge 68, moves or is pulled in an upward direction 70 away from the fabric 11, as shown in FIG. 11. This action often tears the fabric 11 and/or causes delamination, thereby breaking the barrier created by the fabric 11. Alternatively, the patch 62 and the tie 63, while partially delaminating from the fabric 11, also pull the fabric 11 in the upward direction 70, further causing tension and friction against a larger area of the fabric 11.

Therefore, turning back to the present invention, the notch 48 in the notched patch 42 acts to permit the notched patch 42 to act, or react, to tension or a pull on the front tie 40 in a completely different manner. That is, the pressure and tension of such a pull is dispersed more widely along the arms 58 and short edge 44 of the notched patch 42. This action or reaction results in less likelihood of the notched patch 42 causing delamination, a breach or a tear in the fabric 11 of the gown 10 or the entire gown 10 itself. In some instances, do to the conformation of the notched patch 42 and the materials used therein, the area of the notched patch 42 holding the front tie 40 will pull away partially without causing tearing or delamination of the fabric 11 of the gown 10, since the notched patch 42 is not coupled to the fabric 11 of the gown 10 in this area. When the front tie 40 is pulled at an angle away from the notched patch 42, such as, for example, an angle from about ten (10) degrees to about one hundred eighty (180) degrees, the notched patch 42 will greatly resist tearing and/or delamination of the fabric 11 of the gown 10.

Figure 5:
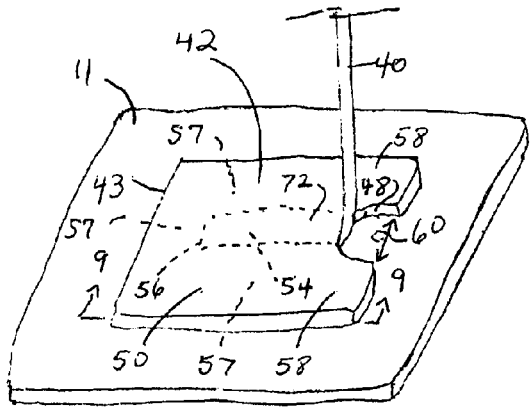
FIG. 5 is a partial perspective view of the notched patch on a section of fabric from the gown shown in FIG. 4, showing the front tie at a 90 degree angle relative to the orientation of the notched patch (the orientation of a portion of the tie under the notched patch shown by phantom lines)

As illustrated in FIGS. 5 and 6, when front 12 of the gown 10 and the notched patch 42 thereon is oriented in a horizontal axis or first axis 74, and the front tie 40 is being pulled in a vertical axis or second axis 76 at about a ninety (90) degree angle relative to the horizontal orientation of the notched patch 42, the arms 58 of the notched patch 42 pull downward and inward in a oblique axis or third axis 78. This is unlike the prior art patch 62, which, when held on the fabric 11 in a horizontal axis or first axis 74, and the tie 64 is being pulled in an upward or vertical direction 70 along a vertical axis 74 at about a ninety (90) degree angle relative to the orientation of the prior art patch 62, a portion 67 of the tie 64 and the adjacent edge 68 of the prior art patch 62 also pull in the upward direction 70 on the vertical or second axis 76, as shown in FIG. 11, following the pull or tension on the tie 64 to encourage delamination and/or tearing (not shown) of the underlying fabric 11 of the gown 10. Such tension also causes the fabric 11 under and adjacent the prior art patch 62 to move in an upward direction 70 generally along the vertical or second axis 76. This action of the fabric 11 is unlike that of the present notched patch 42, in which the fabric 11 surrounding at least the arms 58 of the notched patch 42 is moved in a downward direction 59 or generally along an oblique axis 78.

Turning to FIGS. 1-4, the basis weight of the surgical gown is desirably between about 0.5 osy and about 3.0 osy. Certain areas of the surgical gown may include a fabric having a heavier basis weight. These areas of heavier basis weight are desirably in areas most likely to be contacted and contaminated by liquids, particulate matter, and the like, during surgery, medical procedures, and so forth. These high contamination areas may at least a portion of the front 19, and also include a portion of the sleeves 18. Desirably, the fabric in these high contamination areas has a basis weight of about 1.45 osy to about 3.0 osy. Even more desirably, the fabric in these areas has a basis weight of about 1.45 osy to about 2.0 osy. Alternatively, the surgical gown 10 may utilize the same basis weight throughout.

The present invention is desirably used with an improved cloth-like, liquid-impervious, breathable barrier material, such as, for example only, that disclosed in U.S. Pat. No. 6,037,281, which is incorporated in its entirety herein, and which is discussed below in detail herein. The breathable barrier material possesses a unique balance of performance characteristics and features making the material suitable for use in forming surgical articles, as well as other garment and over-garment applications, such as personal protective equipment applications. The barrier material is a laminate comprising three layers—a top nonwoven layer formed, for example, of spunbond filaments, a bottom nonwoven layer formed, for example, of spunbond filaments, and a middle breathable film layer formed, for example, of a microporous film. The individual layers of barrier material are laminated, bonded or attached together by known means, including thermal-mechanical bonding, ultrasonic bonding, adhesives, and the like. As used herein, the terms "layer" or "web" when used in the singular can have the dual meaning of a single element or a plurality of elements. In another alternative, the material is a nonwoven material of any type known in the art having a film or polymer layer or coating. Such a film or polymer layer or coating is desirably provided in a range of about 0.5 mils to about 3.0 mils.

Commercially available thermoplastic polymeric materials can be advantageously employed in making the fibers or filaments from which the top and bottom layers are formed. As used herein, the term "polymer" shall include, but is not limited to, homopolymer, copolymers, such as, for example, block, graft, random and alternating copolymers, terpolymers, etc., and blends and modifications thereof. Moreover, unless otherwise specifically limited, the term "polymer" shall include all possible geometric configurations of the material, including, without limitation, isotactic, syndiotactic, random and atactic symmetries. As used herein, the terms "thermoplastic polymer" or "thermoplastic polymeric material" refer to a long-chain polymer that softens when exposed to heat and returns to the solid state when cooled to ambient temperature. Exemplary thermoplastic materials include, without limitation, polyvinyl chlorides, polyesters, polyamides, polyfluorocarbons, poly-olefins, polyurethanes, polystyrenes, polyvinyl alcohols, caprolactams, and copolymers of the foregoing.

Nonwoven webs that can be employed as the nonwoven top and bottom layers can be formed by a variety of known forming processes, including spunbonding, airlaying, meltblowing, or bonded carded web formation processes. For example, the top layer and bottom layer are both spunbond nonwoven webs, which have been found advantageous in forming barrier material. Spunbond nonwoven webs are made from melt-spun filaments. The melt-spun filaments are deposited in a substantially random manner onto a moving carrier belt or the like to form a web of substantially continuous and randomly arranged, melt-spun filaments. Spunbond filaments generally are not tacky when they are deposited onto the collecting surface. The melt-spun filaments formed by the spunbond process are generally continuous and have average diameters larger than 7 microns based upon at least 5 measurements, and more particularly, between about 10 and 100 microns. Another frequently used expression of fiber or filament diameter is denier, which is defined as grams per 9000 meters of a fiber or filament.

Spunbond webs generally are stabilized or consolidated (pre-bonded) in some manner immediately as they are produced in order to give the web sufficient integrity and strength to withstand the rigors of further processing. This pre-bonding step may be accomplished through the use of an adhesive applied to the filaments as a liquid or powder which may be heat activated, or more commonly, by an air knife or compaction rolls. As used herein, the term "compaction rolls" means a set of rollers above and below the nonwoven web used to compact the web as a way of treating a just produced, melt-spun filament, particularly spunbond, web, in order to give the web sufficient integrity for further processing, but not the relatively strong bonding of later applied, secondary bonding processes, such as through-air bonding, thermal bonding, ultrasonic bonding and the like. Compaction rolls slightly squeeze the web in order to increase its self-adherence and thereby its integrity. An air knife, as its name implies, directs heated air through a slot or row of openings onto the web to compact and provide initial bonding.

An exemplary secondary bonding process utilizes a patterned roller arrangement for thermally bonding the spunbond web. The roller arrangement typically includes a patterned bonding roll and a smooth anvil roll which together define a thermal patterning bonding nip. Alternatively, the anvil roll may also bear a bonding pattern on its outer surface. The pattern roll is heated to a suitable bonding temperature by conventional heating means and is rotated by conventional drive means, so that when the spunbond web passes through the nip, a series of thermal pattern bonds is formed. Nip pressure within the nip should be sufficient to achieve the desired degree of bonding of the web, given the line speed, bonding temperature and materials forming the web. Percent bond areas within the range of from about 10 percent to about 20 percent are typical for such spunbond webs.

The middle breathable film layer can be formed of any microporous film that can be suitably bonded or attached to top and bottom layers to yield a barrier material having the unique combination of performance characteristics and features described herein. A suitable class of film materials includes at least two basic components: a thermoplastic elastomeric polyolefin polymer and a filler. These (and other) components can be mixed together, heated and then extruded into a mono-layer or multi-layer film using any one of a variety of film-producing processes known to those of ordinary skill in the film processing art. Such filmmaking processes include, for example, cast embossed, chill and flat cast, and blown film processes.

Generally, on a dry weight basis, based on the total weight of the film, the middle breathable film layer will include from about 30 to about 60 weight percent of the thermoplastic polyolefin polymer, or blend thereof, and from about 40 to about 70 percent filler. Other additives and ingredients may be added to the film layer 14 provided they do not significantly interfere with the ability of the film layer to function in accordance with the teachings of the present invention. Such additives and ingredients can include, for example, antioxidants, stabilizers, and pigments.

In addition to the polyolefin polymer, the middle breathable film layer also includes a filler. As used herein, a "filler" is meant to include particulates and other forms of materials which can be added to the film polymer extrusion blend and which will not chemically interfere with the extruded film but which are able to be uniformly dispersed throughout the film. Generally, the fillers will be in particulate form and may have a spherical or non-spherical shape with average particle sizes in the range of about 0.1 to about 7 microns. Both organic and inorganic fillers are contemplated to be within the scope of the present invention provided that they do not interfere with the film formation process, or the ability of the film layer to function in accordance with the teachings of the present invention. Examples of suitable fillers include calcium carbonate ($CaCO3$), various kinds of clay, silica ($SiO2$), alumina, barium carbonate, sodium carbonate, magnesium carbonate, talc, barium sulfate, magnesium sulfate, aluminum sulfate, titanium dioxide ($TiO2$), zeolites, cellulose-type powders, kaolin, mica, carbon, calcium oxide, magnesium oxide, aluminum hydroxide, pulp powder, wood powder, cellulose derivatives, chitin and chitin derivatives. A suitable coating, such as, for example, stearic acid, may also be applied to the filler particles.

As mentioned herein, the breathable film layer may be formed using any one of the conventional processes known to those familiar with film formation. The polyolefin polymer and filler are mixed in appropriate proportions given the ranges outlined herein and then heated and extruded into a film. In order to provide uniform breathability as reflected by the water vapor transmission rate of the film, the filler should be uniformly dispersed through-out the polymer blend and, consequently, throughout the film layer itself so that upon stretching pores are created to provide breathability. For purposes of the present invention, a film is considered "breathable" if it has a water vapor transmission rate of at least 300 grams per square meter per 24 hours (g/m2/24 hours), as calculated using the test method described herein. Generally, once the film is formed, it will have a weight per unit area of less than about 80 grams per square meter (gsm) and after stretching and thinning, its weight per unit area will be from about 10 gsm to about 25 gsm.

The breathable film layer used in the example of the present invention described below is a mono-layer film, however, other types, such as multi-layer films, are also considered to be within the scope of the present invention provided the forming technique is compatible with filled films. The film as initially formed generally is thicker and noisier than desired, as it tends to make a "rattling" sound when shaken. Moreover, the film does not have a sufficient degree of breathability as measured by its water vapor transmission rate. Consequently, the film is heated to a temperature equal to or less than about 5 degrees C. below the melting point of the polyolefin polymer and then stretched using an in-line machine direction orientation (MDO) unit to at least about two times (2×) its original length to thin the film and render it porous. Further stretching of the middle breathable film layer, to about three times (3×), four times (4×), or more, its original length is expressly contemplated in connection with forming middle breathable film layer. After being stretch-thinned, the middle breathable film layer should have an "effective" film gauge or thickness of from about 0.2 mil to about 0.6 mil. The effective gauge is used to take into consideration the voids or air spaces in breathable film layers.

Cuffs 20, as illustrated best in FIGS. 1-4 and as previously noted, are desirably attached to the sleeves 18 of the gown 10. Cuff material may also be attached at the neck of each gown, and so forth (not shown). The cuffs 20 are desirably made from elastic yarns formed from synthetic or natural materials. An example of a synthetic material for forming the elastic yarns is polyurethane. Spandex is an example of polyurethane-based elastomer. More particularly, spandex is a polyurethane in fiber form containing a thermoplastic polyurethane elastomer with at least 85% polyurethane content. Commercial examples of spandex include LYCRA, VYRENE, DORLASTAN, SPANZELLE and GLOSPAN. An example of a natural material for forming elastic yarns is natural rubber. Polyester, nylon, and combinations of any of the foregoing synthetic and/or natural elastic yarns may also be used. The use of these, and other materials to construct sleeves and/or cuffs is disclosed in U.S. Pat. No. 5,594,955, which is incorporated by reference in its entirety herein. In the present embodiment, a cuff 20 is desirably sewn, thermally bonded, ultrasonically bonded, adhesively attached, and so forth to the free end of each sleeve 18.

For the embodiments shown and/or described herein, desirably, as illustrated in FIGS. 1-12, the adhesive on the patches 31, the notched patch 42 and prior art patch 62 has strong shear and friction properties. Desirably, the peel strength of the patches 31, notched patch 42 and prior art patch 62 is equal and sufficiently strong or adhesive to hold the patches 31, notched patch 42, and prior art patch 62 against the outer surface 28 of the fabric 11 of the gown 10.

Figure 7:
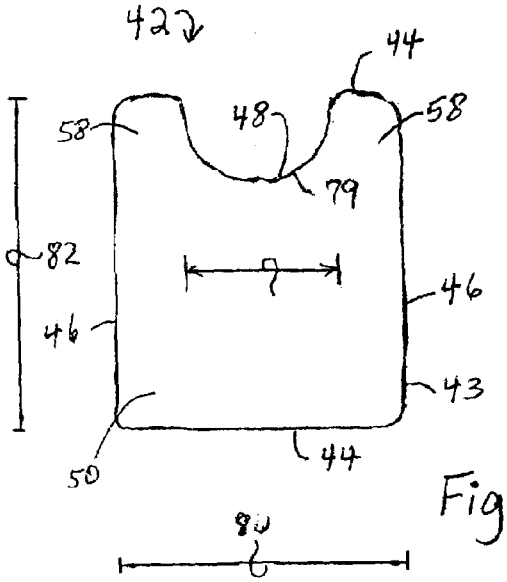
FIG. 7 is a top plan view of the notched patch.
Figure 8:
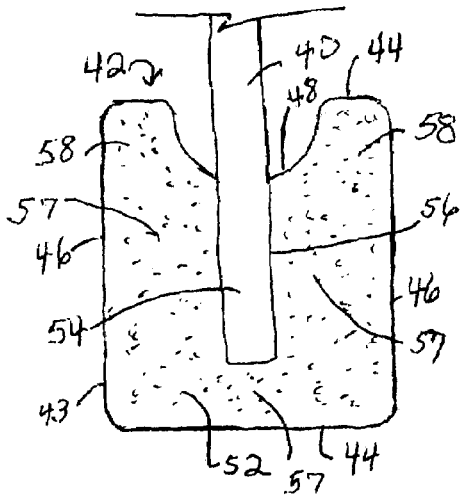
FIG. 8 is a bottom plan view of the notched patch, showing the orientation and attachment of a portion of the front tie to the notched patch.
Figure 9:
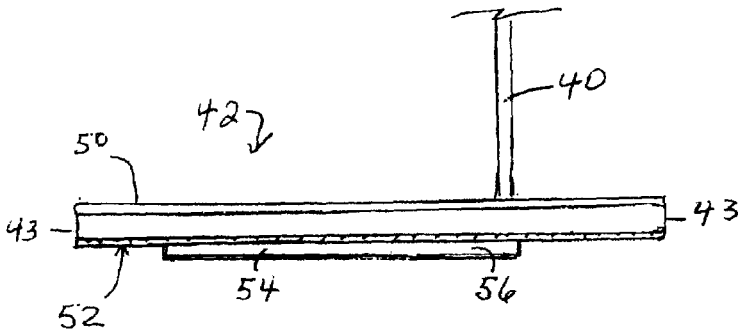
FIG. 9 is a side elevational view of the notched patch of FIG. 5 taken along lines 9-9, showing the orientation of the notched patch and tie to each other.

In one non-limiting embodiment of the notched patch 42, shown in FIG. 7, the notched patch 42 is rectangular and has two long edges 46 which are about 2.87 inches in length, and two short sides 44 which are about 2.5 inches in length. A notch 48 is formed in one of the two short sides 44. The notch is centrally positioned in the side 44, and has a generally semi-circular shape. The depth of the curvature of the notch 48 relative to the side 44 is about 0.75 inch. The greatest width of the notch 48 is about 1.25 inches. The radius 79 of the notch 48 is desirably in a range of about 0.50 inch to about 0.65 inch, when the notched patch 42 is formed by the corresponding stated dimensions.

The notched patch 42 desirably has a width dimension 80 about an outer circumference 56 of the portion 54 of the front tie 40 which is at least twice the width 80 of the portion 54 of the front tie 40. The depth of the indentation or notch 48 is in a range of at least about 5% to about 70% of the greatest diameter of the notched patch 42. More desirably, the depth of the indentation or notch 48 is in a range of at least about 10% to about 50% of the greatest diameter of the notched patch 42. Even more desirably, the depth of the indentation or notch 48 is in a range of at least about 15% to about 35% of the greatest diameter of the notched patch 42. Yet even more desirably, the depth of the indentation or notch 48 is in a range of at least about 16% to about 30% of the greatest diameter of the notched patch 42.

While the notched patch 42 and tie 40 shown and described herein are used with a specific closure, it will be appreciated that the notched patch and tie may be used on any portion(s) of a garment. In addition, the notched patch may be used with another type of coupling device, or a combination of coupling devices, such as, but not by way of limitation, a string, a belt, buckle, snap, hook, hook and loop fastener, hook and loop material, or other fasteners known in the art, and so forth. Any and all manners of closure by the notched patch (with or without a tie) on any portion of a garment are intended herein as enabled.

EXAMPLE

A standard generally rectangular prior art patch 62 (FIG. 10) and a notched patch 42 (FIG. 5), each having a tie attached as previously shown and described herein, were tested to determine the strength of each patch with regard to failure of the patch to remain in place on the material upon which it was applied.

The tensile strength was tested via a tensile tester, in which a 100 N load cell was used. The load cell was conditioned in accordance with the manufacturer's specifications and instructions. Large grips of 6.5 inches×15 inches ±0.04 inch were used on each end of a horizontal platform. A smaller 3 inch grip was positioned a distance above the general center of the platform. Grips and grip faces were free of build-up and the grip faces were free from dents or other damage. The air pressure to operate the grips was set within the manufacturer's maximum load specifications. The load sell was calibrated in accordance with the manufacturer's specifications for the tensile tester being used. The tensile tester parameters were verified to meet the following specifications:

TABLE 1

| | |
|---|---|
| Crosshead Speed: | 305 ± 10mm/minute (12 ± 0.4 inch) |
| Gage Length: | 76 ± 1 mm (3 ± 0.04 inch) |
| Load Units: | Grams-force |
| Full-Scale Load: | 100 N load cell |
| Break Sensitivity: | 70% |

A generally rectangular prior art patch 62 provided by Avery Dennison, Pasadena, Calif., Part No. GCS-2 having adhesive therein and a tie dimensioned to be 2 and ⅜ inch in length and 1/32 inch in width is coupled thereto as shown and described herein was used. A generally rectangular notched patch 42 provided by Avery Dennison, Part No. GCS-2-70069988 and having adhesive thereon and a tie (as described above) coupled thereto, and of the same size as the prior art patch 62 (with the exception of the notch therein) was also used. The ties for each patch were constructed from SFS and were attached in the same manner and location to each patch 62, 42, respectively. The ties were supplied by Avery Dennison as well. Each patch 62 and 42, respectively, with tie attached thereto, was adhesively coupled to three (3) different materials: SMS provided by Kimberly-Clark Corporation, Ultra Impervious™ (SFS) provided by Kimberly-Clark Corporation, and Spunlace provided by Kimberly-Clark Corporation, Roswell, Ga. A specimen of 6.5 inches ±0.125 inch wide by 21±0.125 long was cut from each material. The patch 62 and 42, respectively, were mounted in the center of the platform at 7.5 inches from the left of the platform. The leading patch edge was positioned to the right of the tie as it emerged from under each patch 62, 42. Each specimen was free of folds, wrinkles, or any other visible distortions that would make the specimen abnormal from the rest of the test material. Each specimen was attached to the horizontal platform on the two 6.5 inch ends with the large jaw clips. The tie was attached to a perpendicular angle relative to the platform in the upper grip in a position which was sufficiently taut to remove slack from the tie, but not so taut as to pull the patch or material away from the platform.

The crosshead was started, and it returned when the return limit was reached. Peak load, peak stretch and peak energy was recorded. The laboratory environment was 23±10 degrees C. and 50±10 percent relative humidity.

TABLE 2

Grab Tensile of the Tie in Prior Art Patch and Notched Patch

| | Notched Patch | | Prior Art Patch | | |
|---|---|---|---|---|---|
| Fabric Type | Average | S. D. | Average | S.D. | n |
| SMS | 4.76 | 0.55 | 1.53 | 0.31 | 11 |
| Ultra Impervious™ | 10.04 | 1.24 | 8.45 | 2.61 | 11 |
| Spunlace | 5.24 | 0.64 | 2.52 | 0.46 | 11 |

As the tension increased when the tie of the prior art patch 62 was pulled, the patch 62 pulled away from the material, as shown in FIGS. 11 and 12. As the tension increased when the tie of the notched patch 42 was pulled, the arms 58 of the patch 42 moved downward and inward against the material, causing the patch 42 to downward against the material, thereby encouraging the patch 42 to remain in its position against the material, as illustrated in FIG. 6.

While the present invention has been described in connection with certain preferred embodiments it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

What is claimed is:

1. A nonwoven garment having a patch thereon in which a tie is coupled thereto, the garment comprising:

a front panel, a first back panel and a second back panel, a back tie coupled to a portion of at least one of the first back panel and the second back panel;

a patch including a notch formed therein and having a pair of spaced-apart arms, the patch having a front tie coupled to at least a portion of the patch such that the front tie is positioned to cross the notch and extend outward away from the notch, the patch positioned on the front panel, wherein when the tie is pulled at about a ninety degree angle relative to the patch, the arms adjacent the notch move downward against a fabric of the garment thereby holding the patch firmly thereon, and wherein the back tie and the front tie are configured to couple together to hold the garment about a wearer.

2. The nonwoven garment of claim 1, wherein the garment comprises more than one layer of a nonwoven fabric.

3. The nonwoven garment of claim 2, wherein the garment further comprises a film layer.

4. The nonwoven garment of claim 1, wherein the notch on the patch is formed on an edge of the patch.

5. The nonwoven garment of claim 4, wherein the notch is semicircular in shape.

6. The nonwoven garment of claim 4, wherein the notch is semi-elliptical in shape.

7. The nonwoven garment of claim 4, wherein the patch is configured to have a coupled area about the tie.

8. The nonwoven garment of claim 1, wherein the tie is coupled to the patch, but not to the nonwoven garment.

9. The nonwoven garment of claim 8, wherein the tie is coupled to the patch via an adhesive.

10. The nonwoven garment of claim 1, wherein the patch is coupled to the nonwoven garment via an adhesive.

11. A notched patch in which a tie is coupled thereto for use on a nonwoven garment, the patch comprising:

a patch including a notch formed therein and having a pair of spaced-apart arms, the patch having a tie coupled to at least a portion of the patch such that the tie is positioned to cross the notch and extend outward away from the notch, the patch coupled to a garment, wherein when the tie is pulled in at about a ninety degree angle relative to the patch, the arms adjacent the notch move downward against a fabric of a garment thereby holding the patch firmly thereon.

12. The notched patch of claim 11, wherein the notch on the patch is formed on an edge of the patch.

13. The notched patch of claim 12, wherein the notch is semicircular in shape.

14. The notched patch of claim 12, wherein the notch is semi-elliptical in shape.

15. The notched patch of claim 12, wherein the patch is configured to have a coupled area about the tie.

16. The notched patch of claim 12, wherein the tie is coupled to the patch, but not to a nonwoven garment.

17. The notched patch of claim 16, wherein the tie is coupled to the patch via an adhesive.

18. The notched patch of claim 11, wherein the patch is coupled to a nonwoven garment via an adhesive.

19. The notched patch of claim 11, wherein a depth of an indentation defining the notch in the notched patch is in a range of at least about 5% to about 70% of a greatest diameter of the patch.

20. The notched patch of claim 11, wherein the depth of the indentation defining the notch in the notched patch is in a range of at least about 10% to about 50% of the greatest diameter of the patch.

21. The nonwoven garment of claim 12, wherein the depth of the indentation defining the notch in the notched patch is in a range of at least about 16% to about 35% of the greatest diameter of the patch.

* * * * *